US009616667B2

(12) United States Patent
Toda

(10) Patent No.: US 9,616,667 B2
(45) Date of Patent: Apr. 11, 2017

(54) INKJET HEAD AND METHOD OF MANUFACTURING INKJET HEAD

(71) Applicant: CANON KABUSHIKI KAISHA, Tokyo (JP)

(72) Inventor: Kyosuke Toda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 13/772,657

(22) Filed: Feb. 21, 2013

(65) Prior Publication Data

US 2013/0222463 A1 Aug. 29, 2013

(30) Foreign Application Priority Data

Feb. 24, 2012 (JP) ..... 2012-038858

(51) Int. Cl.
*B41J 2/14* (2006.01)
*B41J 2/16* (2006.01)

(52) U.S. Cl.
CPC ..... *B41J 2/1623* (2013.01); *B41J 2/14072* (2013.01); *B41J 2/1601* (2013.01); *B41J 2/1607* (2013.01)

(58) Field of Classification Search
CPC ..... B41J 2/1623; B41J 2002/14475; B41J 2/1607; B41J 2/1601; B41J 2/14072; B41J 2/1606
USPC ..... 347/47, 71, 45, 20
See application file for complete search history.

(56) References Cited

U.S. PATENT DOCUMENTS 4,751,532 A * 6/1988 Fujimura et al. ..... 347/55
4,878,992 A * 11/1989 Campanelli ..... B23D 61/10 156/250
5,798,778 A * 8/1998 Kimura ..... B41J 2/14016 347/45
6,254,215 B1 * 7/2001 Hiroki et al. ..... 347/20
6,511,156 B1 * 1/2003 Kazama ..... B41J 2/1433 347/47
7,655,275 B2 * 2/2010 Nelson et al. ..... 427/299
7,784,174 B2 * 8/2010 Kanda et al. ..... 29/611
2006/0093787 A1 * 5/2006 Chen ..... B41J 2/16 428/137
2007/0037413 A1 * 2/2007 Ishihara et al. ..... 438/792
(Continued)

FOREIGN PATENT DOCUMENTS

JP 59-086634 A 5/1984
JP 2001-246757 A 9/2001
(Continued)

*Primary Examiner* — Matthew Luu
*Assistant Examiner* — Patrick King
(74) *Attorney, Agent, or Firm* — Canon U.S.A., Inc. IP Division

(57) ABSTRACT

An inkjet head including a substrate configured to discharge ink including a supporting surface formed of a resin material and configured to support the substrate, the supporting substrate including a portion continuing to a surface intersecting the supporting surface and forming a corner portion, the portion forming the corner portion including a non surface treated area which is not surface treated, the supporting surface including a portion adjacent to the non surface treated area being surface treated areas which is surface treated, wherein the substrate and the supporting surface are bonded via an adhesive agent disposed in the non surface treated area and the surface treated area.

18 Claims, 8 Drawing Sheets

(56) References Cited

U.S. PATENT DOCUMENTS

| | | | | |
|---|---|---|---|---|
| 2007/0076058 | A1* | 4/2007 | Weaver | B41J 2/14129 347/65 |
| 2007/0195123 | A1* | 8/2007 | Deguchi et al. | 347/44 |
| 2007/0279453 | A1* | 12/2007 | De Kegelaer | 347/33 |
| 2008/0143784 | A1* | 6/2008 | Ono | 347/44 |
| 2009/0136875 | A1* | 5/2009 | Kubota | B41J 2/14129 347/65 |
| 2009/0147051 | A1* | 6/2009 | Yamamoto | 347/47 |
| 2010/0302312 | A1* | 12/2010 | Yamamoto et al. | 347/45 |
| 2011/0063369 | A1* | 3/2011 | Okamura | 347/44 |
| 2011/0080449 | A1* | 4/2011 | von Essen et al. | 347/33 |
| 2012/0115985 | A1* | 5/2012 | Ishizuka | B41J 2/1603 523/400 |

FOREIGN PATENT DOCUMENTS

| | | | | |
|---|---|---|---|---|
| JP | 2001246757 | A | * | 9/2001 |
| JP | 2006-289637 | A | | 10/2006 |
| JP | 2007-015238 | A | | 1/2007 |
| JP | 2008-168623 | A | | 7/2008 |

* cited by examiner

INKJET HEAD AND METHOD OF MANUFACTURING INKJET HEAD

BACKGROUND OF THE INVENTION

Field of the Invention

The present disclosure relates to an inkjet head configured to discharge ink to record on a recording medium and a method of manufacturing the inkjet head.

Description of the Related Art

An inkjet head has a configuration in which a recording element substrate and a supporting member are bonded using an adhesive agent. In Japanese Patent Laid-Open No. 2008-168623, a configuration in which a UV curable adhesive agent is used to position the recording element substrate and the supporting member with high degree of accuracy is disclosed.

The supporting member configured to support the recording element substrate coming into contact with various types of ink is formed of a resin material having a low reactivity in many cases. However, since there is a case in which adhesiveness between the supporting member formed of the resin material and the adhesive agent may be low, there is a possibility that a leakage of ink or color mixture of ink may occur at a bonded portion between the recording element substrate and the supporting member.

Here, as disclosed in Japanese Patent Laid-Open No. 59-086634, there is a known technology that improves the adhesiveness with respect to the adhesive agent by applying plasma treatment on a surface of the member formed of the resin material. A surface modified portion is chemically activated, is increased in hydrophilic property in comparison with a surface non-modified portion, and is increased in adhesiveness with respect to the adhesive agent.

In order to position the recording element substrate with respect to the supporting member with high degree of accuracy, errors generated due to repetitive positioning accuracy or a formation error of the supporting member are corrected by the thickness of the adhesive agent. In other words, stable application of the adhesive agent of a desired height or higher on a supporting surface of the supporting member which supports the recording element substrate is required.

However, when a surface treatment such as plasma treatment is applied to the supporting surface, the following problems may occur. In other words, when the surface treatment is applied, the supporting surface formed of a resin material melts and hence corner portions are deformed, and the curvature of the corner portion may be increased. If the curvature of the corner portion is increased, the adhesive agent is liable to slip down from the corner portions, and hence the application of the adhesive agent to the desired height or higher may become difficult. In particular, when the width of the supporting surface on which the adhesive agent is applied is small, this problem becomes prominent.

SUMMARY OF THE INVENTION

Aspects of the present invention disclosed herein at least provide an inkjet head in which when an adhesive agent is applied to a surface treated supporting surface, the adhesive agent is prevented from slipping down easily from the supporting surface and is disposed stably thereon, and a method of manufacturing the inkjet head.

An inkjet head includes a substrate configured to discharge ink; a supporting surface formed of a resin material and configured to support the substrate, the supporting surface including a portion continuing to a surface intersecting the supporting surface and forming a corner portion, the corner portion including a non surface treated area that is not surface treated, the supporting surface including a portion adjacent to the non surface treated area being surface treated area which is surface treated; wherein the substrate and the supporting surface are bonded via an adhesive agent disposed in the non surface treated area and the surface treated area.

Further features of the present disclosure will become apparent from the following description of exemplary embodiments with reference to the attached drawings.

DESCRIPTION OF THE EMBODIMENTS

Figure 1:
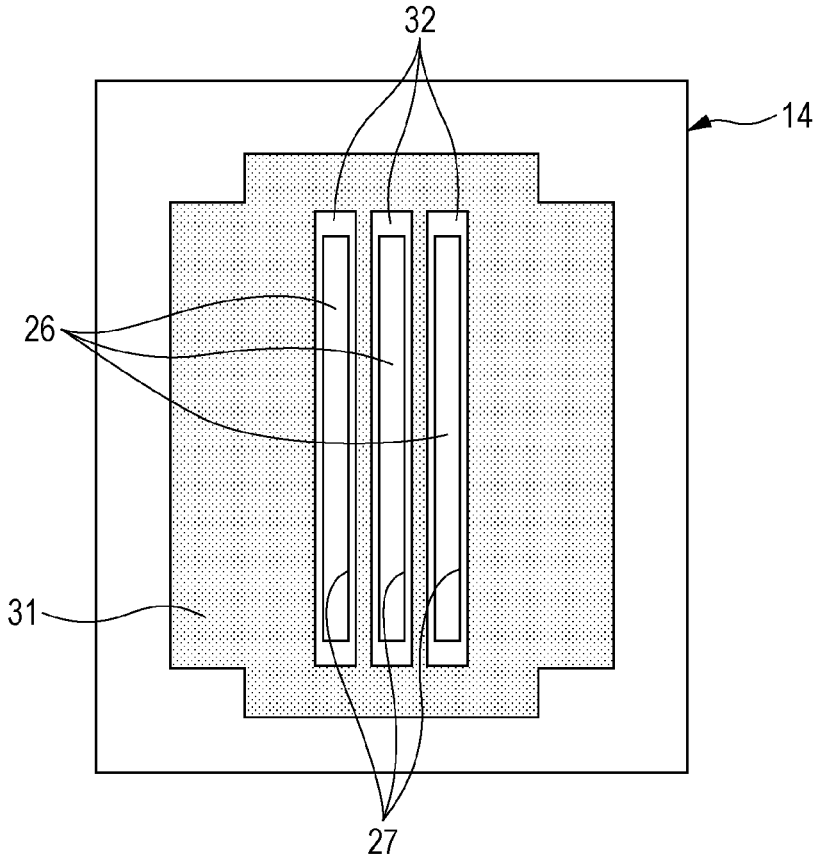
FIG. 1 illustrates an ink storing member of Example 1 viewed from the side of a supporting surface for explaining an area where plasma treatment is applied and an area where plasma treatment is not applied.

Referring now to the drawings, examples of the invention will be described.

Example 1

Figure 2:
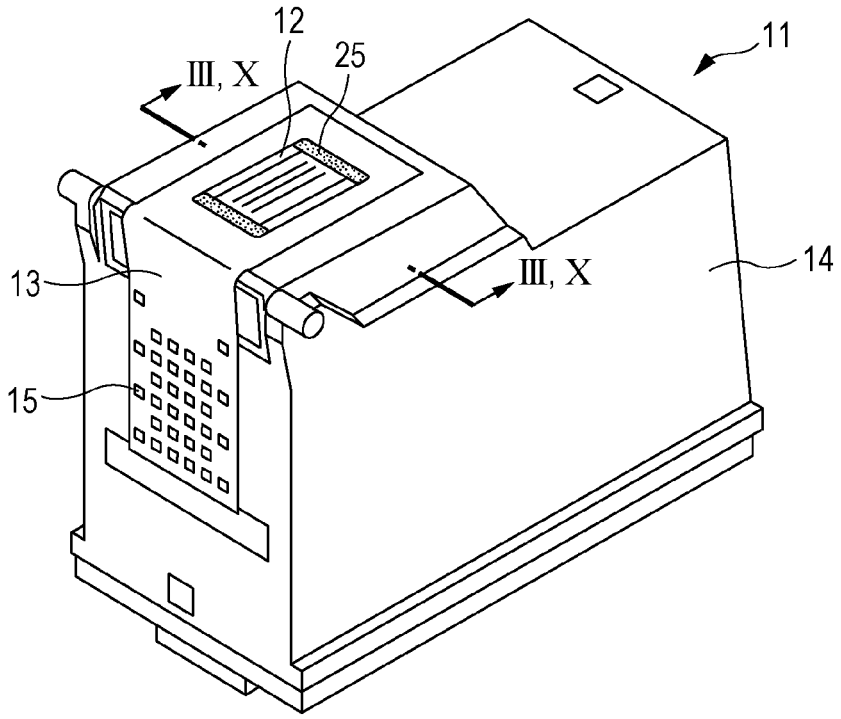
FIG. 2 is a perspective view of an inkjet head.

FIG. 2 shows an inkjet head 11 configured to eject three colors of inks. The inkjet head 11 includes a recording element substrate 12, an electric wiring tape 13, and an ink storing member 14.

Figure 9A:
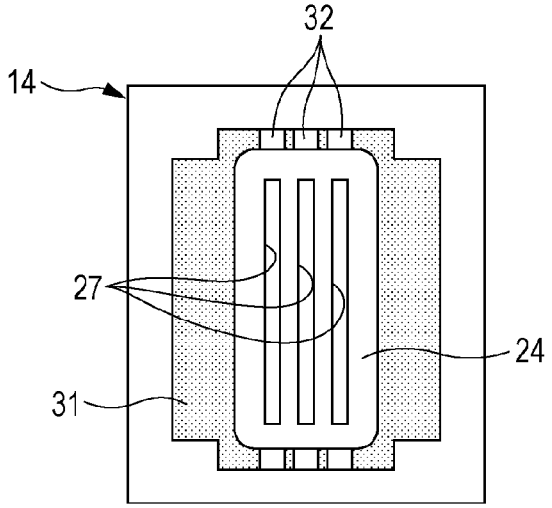
FIG. 9A illustrates the modification of Example 1 in a state in which the adhesive agent is applied.
Figure 9B:
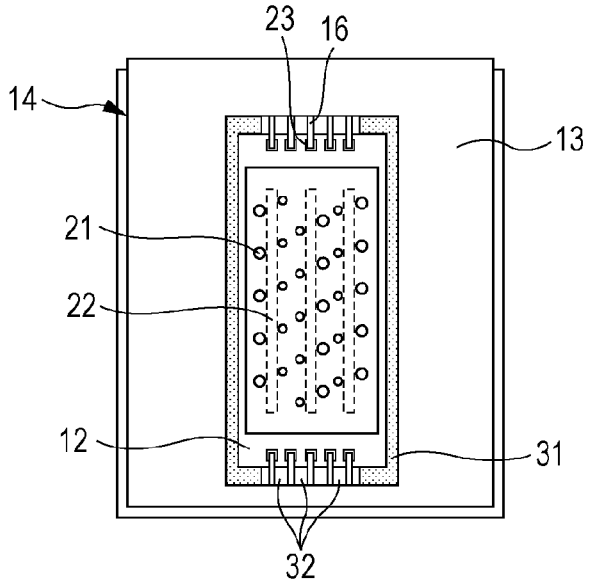
FIG. 9B illustrates the modification of Example 1 in a state in which a recording element substrate and an electric wiring tape are electrically connected.

The recording element substrate 12 includes discharge ports 21 (FIG. 9B) configured to discharge the ink and energy generating elements (not illustrated) provided so as to correspond to the discharge ports 21. The electric wiring tape 13 is electrically connected to the recording element substrate, and a connecting portion between the recording element substrate 12 and the electric wiring tape 13 is sealed by a sealing material 25. An electric signal is transmitted from an inkjet recording apparatus on which the inkjet head 11 is mounted via a contact portion 15 provided on the electric wiring tape 13 to the recording element substrate 12, and the energy generating elements are driven. Ink is discharged by energy generated in association with driving of the energy generating elements. Examples of energy generating elements include a thermoelectric conversion element and a piezoelectric element.

Figure 3:
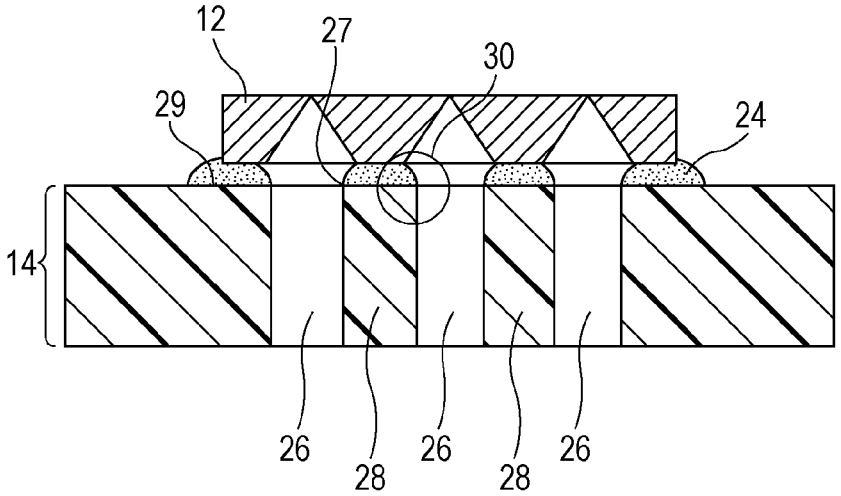
FIG. 3 is a partial cross-sectional view taken along the line III-III in FIG. 2.

In the ink storing member 14, the ink discharged from the discharge ports 21 is stored. FIG. 3 is a partial cross-sectional view taken along the line III-III in FIG. 2. As illustrated in the drawing, an adhesive agent 24 is disposed on a supporting surface 29 of the ink storing member 14, and the recording element substrate 12 is bonded thereto via the adhesive agent 24. In this example, a UV curable adhesive agent is used as the adhesive agent 24. However, a heat-curable adhesive agent is also applicable. The ink storing member 14 is a member formed of a resin material such as modified-Polyphenylene-ether, and is molded by injection molding.

The ink is supplied to the recording element substrate 12 via flow channels 26 provided in the ink storing member 14. In Example 1, three of the flow channels 26 are provided corresponding to the three colors of inks and between the plurality of flow channels 26 are segmentalized by walls 28. The supporting surface 29 is formed with openings 27 (supply ports) of the flow channels 26.

As illustrated in FIG. 3, the ink storing member 14 is formed with corner portions 30 (a portion surrounded by a circle in FIG. 3) which are formed by the supporting surface 29 and inner surfaces of the walls 28 extending along the direction intersecting the supporting surface 29 (the vertical direction in Example 1). The curvature of the corner portions 30 is set to be small within a range which can be formed by the injection molding. In other words, the corner portions 30 are each formed of substantially two half-lines, but include an arc which may be generated by molding. In Example 1, the angle of the corner portion 30 is a right angle.

In Example 1, in order to improve adhesiveness between the adhesive agent 24 and the supporting surface 29 of the ink storing member 14, plasma treatment is applied partly on the supporting surface 29.

Figure 4:
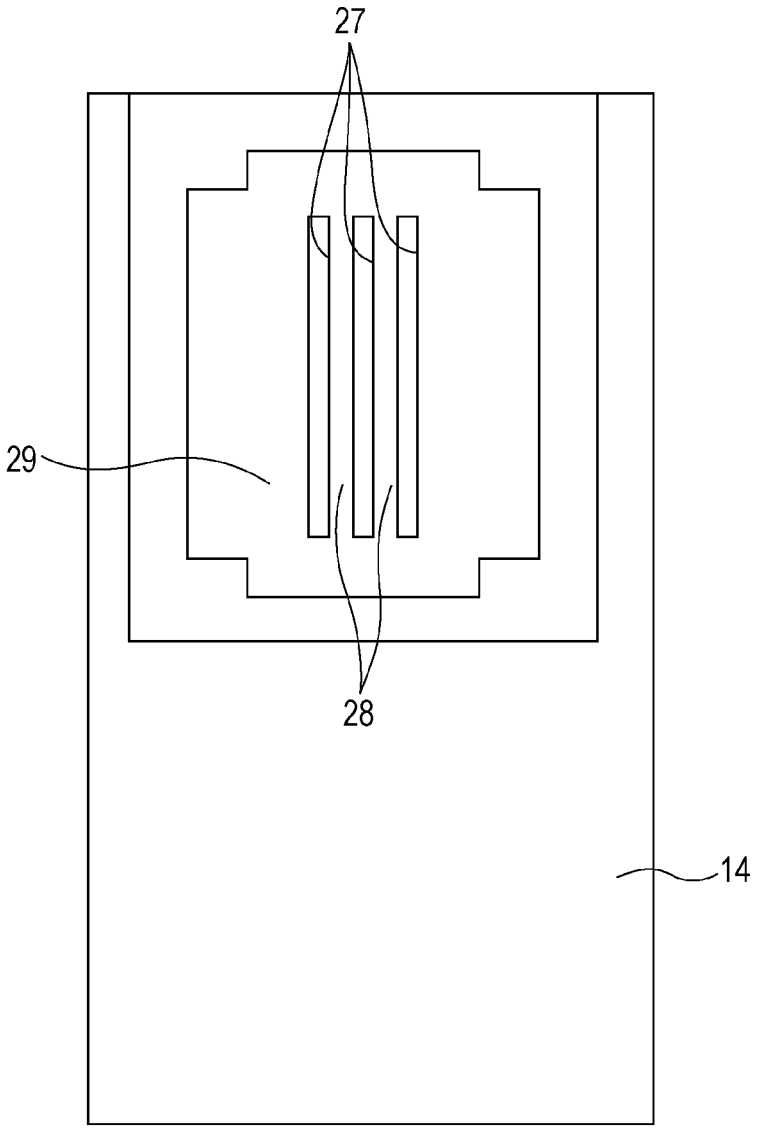
FIG. 4 illustrates the ink storing member of Example 1 viewed from the side of the supporting surface.

FIG. 4 illustrates the ink storing member 14 in a state in which the recording element substrate 12 is not mounted viewed from the side of the supporting surface 29. FIG. 1 illustrates the ink storing member 14 from the side of the supporting surface 29 in the same manner as FIG. 4. As illustrated in FIG. 1, the supporting surface 29 of the ink storing member 14 includes an area 31 (surface treated area) where plasma treatment is applied and areas 32 (non surface treated area) where plasma treatment is not applied.

More specifically, in the supporting surface 29, plasma treatment is not applied to peripheral edge portions of the openings 27 of the flow channels 26, and plasma treatment is applied to areas adjacent to the peripheral edge portions and surrounding the peripheral edge portions. In other words, part of the supporting surface 29 where the corner portions 30 are formed are the non surface treated areas and hence no plasma treatment is applied thereto. Therefore, the corner portions 30 are not susceptible to deformation caused by plasma treatment, and the shape at the time of molding is maintained.

Figure 5:
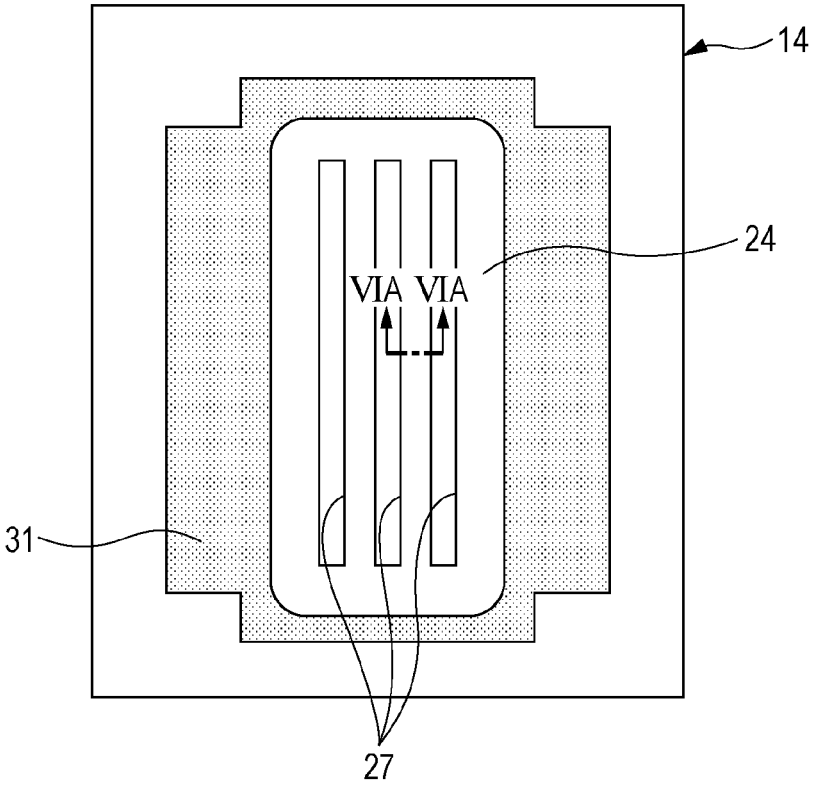
FIG. 5 illustrates the ink storing member of Example 1 viewed from the side of the supporting surface for explaining an area where an adhesive agent is to be applied.
Figure 6A:
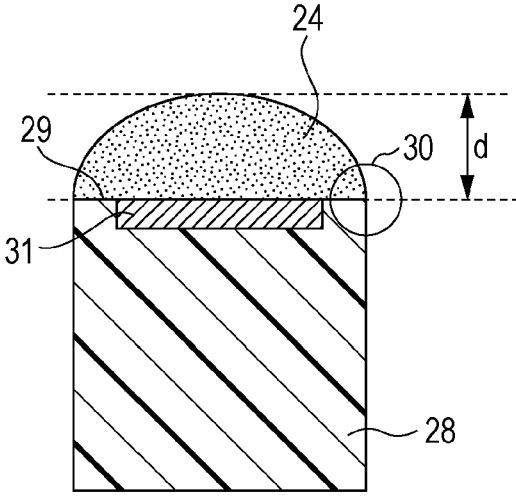
FIG. 6A is a partial cross-sectional view taken along the line IVA-IVA in FIG. 5, illustrating the ink storing member of Example 1 after the adhesive agent is applied.
Figure 6B:
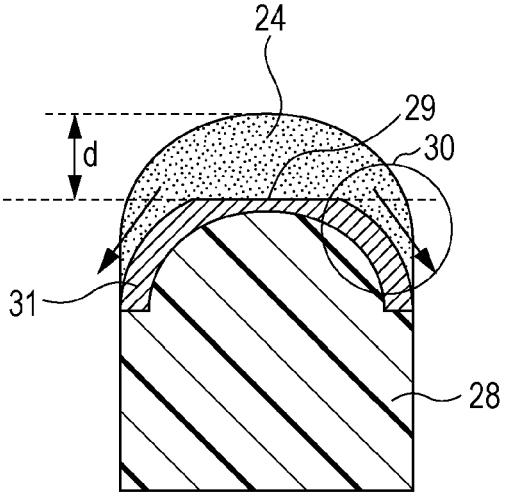
FIG. 6B illustrates a comparative example corresponding to FIG. 6A.

FIG. 5 is a drawing illustrating a state in which the adhesive agent 24 is applied to the supporting surface 29, and FIGS. 6A and 6B are partial cross-sectional views taken along the line VIA-VIA in FIG. 5. When applying the adhesive agent 24 on the supporting surface 29, there are a method of using a dispenser and a method of applying the adhesive agent 24 by transferring from a separate member such as a film on which the adhesive agent is disposed.

FIG. 6A is a drawing corresponding to Example 1, and FIG. 6B is a drawing corresponding to a comparative example. The comparative example illustrates a case where plasma treatment is applied to the entire area of the supporting surface 29. Since the corner portions 30 are deformed due to plasma treatment, the curvature of the corner portions 30 is increased in comparison with the state before plasma treatment is applied. When the adhesive agent 24 is applied to the supporting surface 29, the adhesive agent assumes the shapes illustrated in FIGS. 6A and 6B due to a surface extension of the adhesive agent 24.

After the shape of the adhesive agent 24 has stabilized, the recording element substrate 12 is arranged on the supporting surface 29 with high degree of accuracy. Subsequently, the adhesive agent 24 is irradiated with UV rays and cured, and then the recording element substrate 12 is positioned on the supporting surface 29 of the ink storing member 14 and fixed.

Here, the inventors are confirmed through experiment that even when the substantially same amount of the adhesive agent 24 is applied in Example 1 and in the comparative example, the adhesive agent 24 is liable to slip down in the direction indicated by arrows in FIG. 6B under its own weight in the case of the comparative example in which the curvature of the corner portions 30 is larger. When the adhesive agent 24 is slipped down and a height d (FIG. 6) of the adhesive agent 24 is decreased, the recording element substrate 12 may be positioned in a state of not in contact with the adhesive agent 24. In such a case, there arises a probability that different colors of inks are mixed. When the adhesive agent 24 is slipped down and enters the flow channels 26, the surface area of the flow channels 26 is decreased, and hence there may be a risk that the ink can hardly be supplied.

In contrast, in Example 1 illustrated in FIG. 6A, center portions of the walls 28 provided between the plurality of flow channels 26 are plasma treated and hence is hydrophilic so that the adhesiveness with respect to the adhesive agent 24 is improved. The corner portions 30 not plasma treated are not susceptible to deformation due to plasma treatment and sill keep the shape at the time of molding. Therefore, the probability of slip down of the adhesive agent 24 is low in comparison with the comparative example. In addition, since the water-repellent property is relatively high in comparison with the center portions, the corner portions 30 are in the state of preventing easy slipping down of the adhesive agent 24 owing to the surface tension.

With the configuration as described above, when the adhesive agent 24 is applied to the supporting surface 29 which is surface treated such as plasma treatment, the adhesive agent 24 is hardly slipped down from the supporting surface 29, and may be disposed stably thereon. Also, by applying plasma treatment on the supporting surface 29, the adhesiveness between the supporting surface 29 of the ink storing member 14 and the adhesive agent 24 is improved.

In particular, it is preferable that when the width of the walls 28 (the distance between the adjacent openings 27 in the direction of arrangement) is 0.4 mm, the width of the corner portions 30 is set to a value on the order of 0.05 to 0.1 mm and plasma treatment is not applied to the corner portions 30.

When the width of the recording element substrate 12 is reduced for reducing costs, reduction of the width of the walls 28 provided between the flow channels 26 of the ink storing member 14 is required correspondingly. Example 1 is specifically effective when the width of the walls 28 is small. It is because that if the width of the walls 28 is small, the amount of the adhesive agent 24 which can be applied without slipping down into the flow channels 26 becomes small, and hence the height of the adhesive agent 24 becomes lower correspondingly.

In order to form the area 31 where plasma treatment is applied and the areas 32 where plasma treatment is not applied to the supporting surface 29, a mask is arranged in the peripheral portions of the openings 27 to avoid direct irradiation the plasma.

In the configuration of Example 1 described above, plasma treatment is not applied to the entire areas of the corner portions 30. However, the invention is not specifically limited thereto. In other words, what is essential is only that at least part of the corner portions 30 included in the supporting surface 29 which supports the recording element substrate 12 includes the areas 32 where plasma treatment is not applied and part of the corner portions 30 may be plasma treated. In particular, the ratio of the area 32 where plasma treatment is not applied is preferably 50% or more of the corner portions 30. In Example 1 illustrated in FIG. 1, the ratio of the areas 32 where plasma treatment is not applied is 100% of the corner portions 30.

Figure 7:
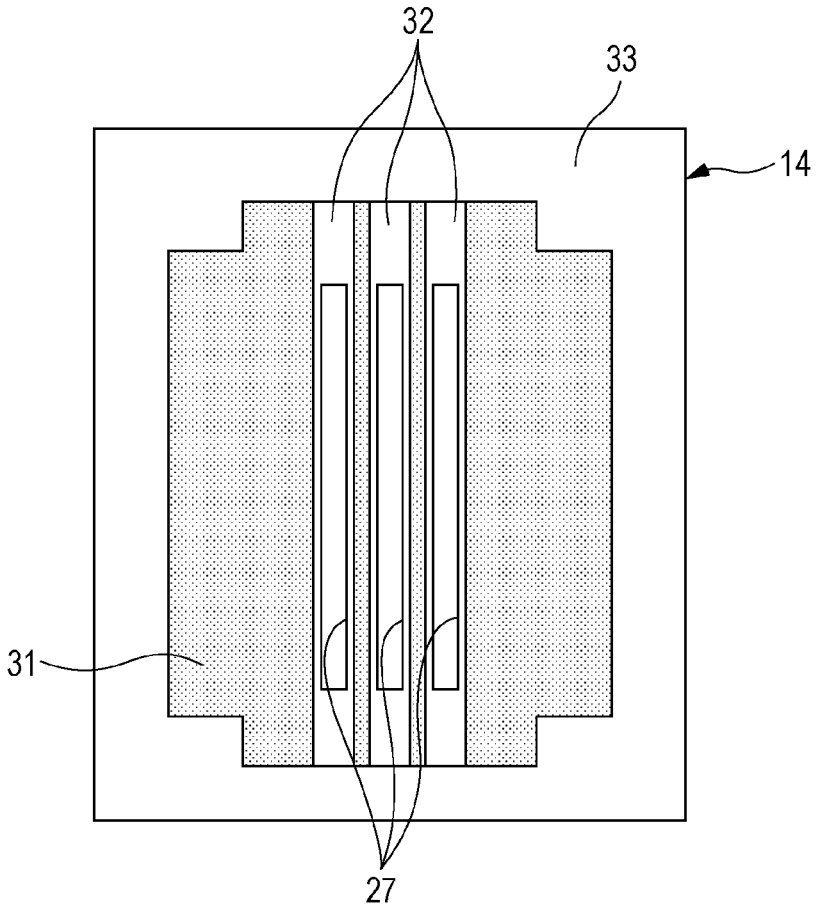
FIG. 7 illustrates an ink storing member of a modification of Example 1 viewed from the side of a supporting surface for explaining an area where plasma treatment is applied and an area where plasma treatment is not applied.

FIG. 7 illustrates the supporting surface 29 of the ink storing member 14 as a modification of Example 1. FIG. 7 corresponds to FIG. 1, and illustrates the area 31 where plasma treatment is applied and the areas 32 where plasma treatment is not applied of this modification. In this modification, the area where plasma treatment is not applied to an outer peripheral portion 33 of the supporting surface 29 and the areas where plasma treatment is not applied provided in the peripheral portions of the openings 27 continue when viewing the ink storing member 14 from the side where the recording element substrate 12 is disposed.

Figure 8:
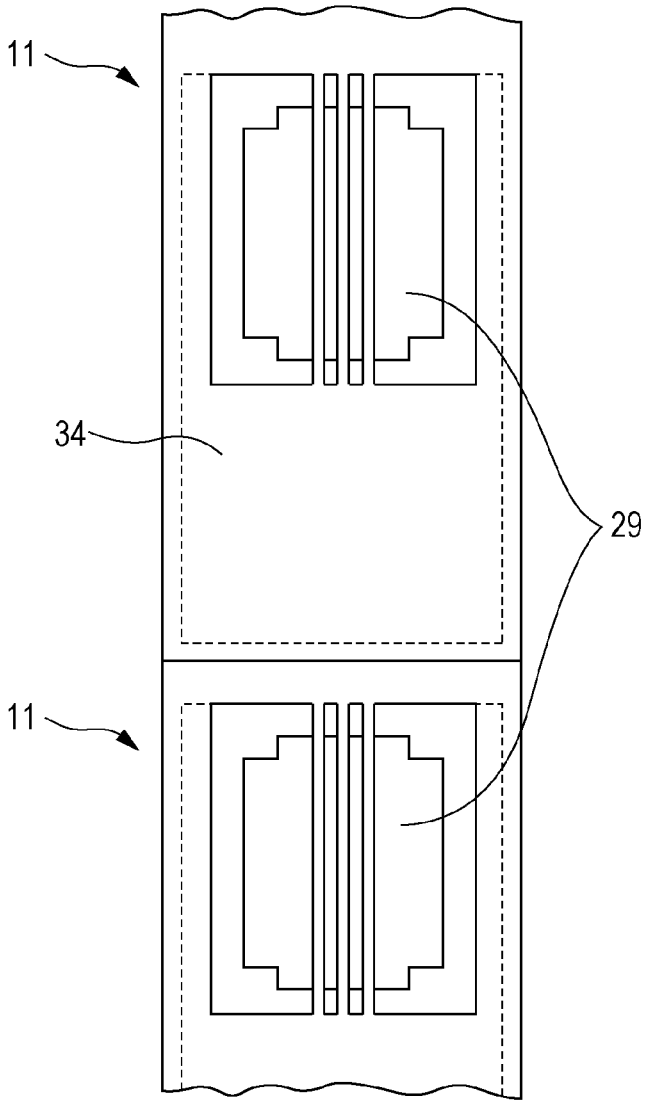
FIG. 8 illustrates a mask used for applying plasma treatment of the modification of Example 1.

Therefore, by using a mask 34 illustrated in FIG. 8, plasma treatment may be performed for the supporting surfaces 29 of a plurality of the ink storing members 14 at once. Therefore, by the provision of the area 31 where plasma treatment is applied and the areas 32 where plasma treatment is not applied to the supporting surface 29 as in this modification, tact time at the time of manufacture may be reduced.

In this modification as well, the adhesive agent 24 is applied to the supporting surface 29 (FIG. 9A), the recording element substrate 12 is arranged on the supporting surface 29 via the adhesive agent 24 (FIG. 9B), and the UV curable adhesive agent is cured.

Figure 9C:
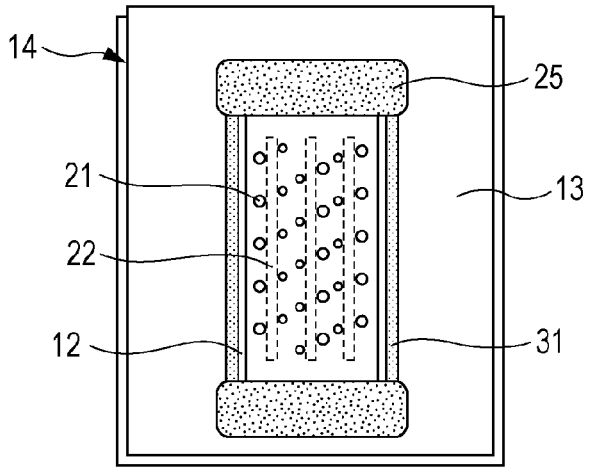
FIG. 9C illustrates the modification of Example 1 in a state in which a sealing agent is applied.

Also, the recording element substrate 12 and the electric wiring tape 13 are electrically connected by a lead 16 provided on the electric wiring tape 13. Subsequently, the sealing material 25 is applied to protect the periphery of the lead 16 as an electric connecting portion (FIG. 9C).

At this time, although the sealing material 25 only have to be applied to the periphery of the lead 16, the sealing material 25 is applied also on the areas 32 where plasma treatment is not applied as illustrated. Accordingly, areas of the supporting surface 29 where plasma treatment is not applied and hence the adhesiveness is not improved are not exposed to the outside.

As described above, by the provision of the area where plasma treatment is applied and the areas where plasma treatment is not applied as in this modification, productivity of the inkjet head 11 to which plasma treatment is applied may be improved. Also, by applying the sealing material 25, the areas which are not improved in adhesiveness are not exposed to the outside, and hence the risk of ink leakage may also be reduced.

Example 2

Figure 10:
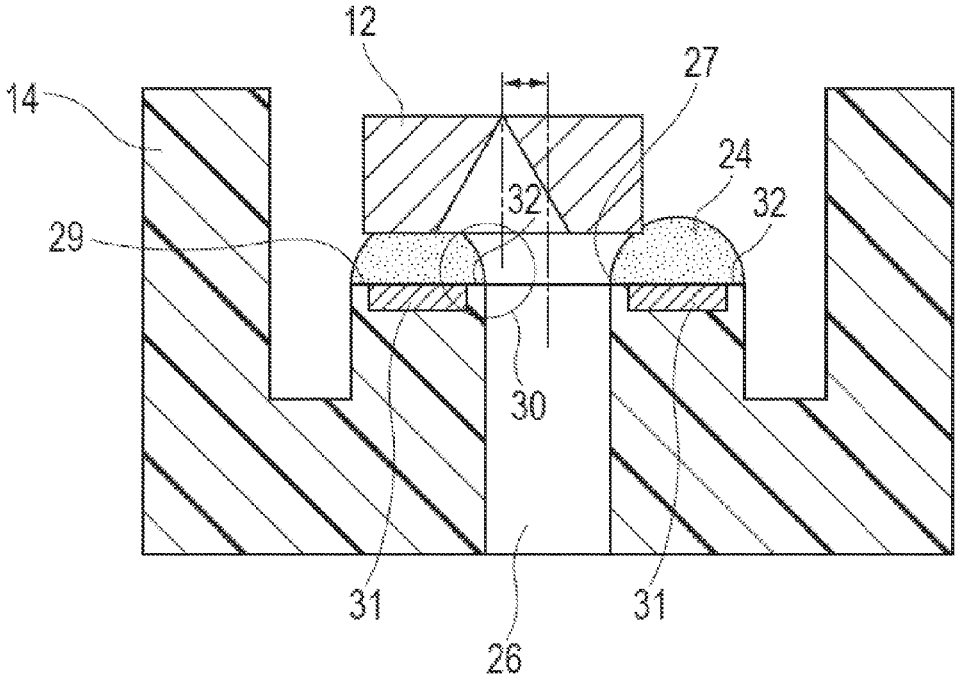
FIG. 10 is a partial cross-sectional view taken along the line X-X in FIG. 2 illustrating Example 2.

FIG. 10 is a cross-sectional view of the inkjet head 11 which discharges mono-color ink according to Example 2. In Example 2 as well, the area 31 where plasma treatment is applied and the areas 32 where plasma treatment is not applied are provided on the supporting surface 29 as in the same manner as the above-described Example. Accordingly, with the configuration as described above, when the adhesive agent 24 is applied to the supporting surface 29, the adhesive agent 24 is hardly slipped down from the supporting surface 29, and may be disposed stably thereon. Also, the adhesiveness between the supporting surface 29 of the ink storing member 14 and the adhesive agent 24 is improved.

As illustrated in FIG. 10, even when the positioning of the recording element substrate 12 is shifted in the lateral direction in the drawing with respect to the ink storing member 14, the adhesive agent 24 is held at a sufficient height and hence the recording element substrate 12 can easily be adhered to the adhesive agent 24. Therefore, with the configuration of Example 2, the permitted shift in the lateral direction is increased, and hence the probability of ink leakage which may occur in association with the shift may be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-038858 filed Feb. 24, 2012, which is hereby incorporated by reference herein in its entirety.

What is claimed is:

1. An inkjet head comprising:

a substrate including a discharge port configured to discharge liquid and including an outer side and an interior side on a side of the substrate opposite the outer side; and a supporting member formed of a resin material and including a supporting surface configured to face the substrate interior side and support the substrate, wherein the supporting surface includes a first supply port and a second supply port, which are adjacent each other, wherein an area of the supporting surface between the first supply port and the second supply port includes a first area located on a first supply port side, a second area located on a second supply port side, and a third area located between the first area and the second area, wherein the third area is an area where plasma treatment is applied, and each of the first and second areas is an area where plasma treatment is not applied, and wherein the substrate interior side is attached to the first area, the second area, and the third area.

2. The inkjet head according to claim 1, wherein an outer peripheral portion of the supporting surface, viewed from the side where the substrate is arranged, remains in a first state after the plasma treatment, and wherein the first area, the second area, and the outer peripheral portion of the supporting surface are contiguous when viewed from the side where the substrate is arranged.

3. The inkjet head according to claim 2, wherein a sealing material is disposed on the first area, the second area, the outer peripheral portion, and the substrate interior side.

4. The inkjet head according to claim 1, wherein the first area and the second area have a water-repellent property that is greater than a water-repellent property of the third area.

5. A method of manufacturing an inkjet head, the method comprising:

providing a substrate including a discharge port configured to discharge liquid and including an outer side and an interior side on a side of the substrate opposite the outer side; and providing a supporting member formed of a resin material and including a supporting surface configured to face the substrate interior side and support the substrate, wherein the supporting surface includes a first supply port and a second supply port, which are adjacent each other, wherein an area of the supporting surface between the first supply port and the second supply port includes a first area located on a first supply port side, a second area located on a second supply port side, and a third area located between the first area and the second area;

applying plasma treatment to the third area and not applying plasma treatment to the first and second areas; and attaching the substrate interior side to the first area, the second area, and the third area.

6. The inkjet head according to claim 1, wherein the first area, the second area, and the third area are provided along the first supply port.

7. The inkjet head according to claim 1, wherein the first supply port and the first area are adjacent to each other, and the second supply port and the second area are adjacent to each other.

8. The inkjet head according to claim 1, wherein the first area and the third area are adjacent each other, and the second area and the third area are adjacent each other.

9. The inkjet head according to claim 1, wherein an adhesive agent bonds the substrate and the supporting surface, and the adhesive agent is disposed on the first area, the second area, and the third area.

10. The inkjet head according to claim 1, wherein the hydrophilic properties of the third area after the plasma treatment is greater than the hydrophilic properties of the third area before the plasma treatment.

11. The inkjet head according to claim 1, wherein the adhesiveness properties of the third area after the plasma treatment is greater than the adhesiveness properties of the third area before the plasma treatment.

12. The inkjet head according to claim 1, wherein the substrate is continuous, resides outside of each supply port, and is a recording element substrate.

13. The inkjet head according to claim 1, wherein the discharge port is positioned outside the first supply port and the second supply port.

14. An inkjet head comprising:

a substrate including a discharge port configured to discharge liquid; and a supporting member formed by injection molding of a resin material, wherein the supporting member includes ink flow channels that lead to a first supply port and a second supply port separated from the first supply port by a wall, and includes a supporting surface configured to support the substrate, wherein the wall and the supporting surface meet to form a corner portion at each supply port, wherein curvature of the corner portions formed by the injection molding of the corner portions prior to a plasma treatment remain within a predetermined curvature range that resists ink leakage after plasma treatment of the supporting member, and wherein a corner portion having the curvature within the predetermined curvature range is covered by the substrate to support the substrate.

15. The inkjet head according to claim 14, wherein, with the substrate and the supporting surface bonded with an adhesive agent and in a case where the curvature of the corner portions are within the predetermined curvature range after plasma treatment of the supporting member, probability of slip-down of the adhesive agent that causes ink leakage is less than in a case where the curvature of the corner portions are outside of the predetermined curvature range after plasma treatment of the supporting member with the substrate and the supporting surface bonded with an adhesive agent.

16. The inkjet head according to claim 14, wherein the hydrophilic properties of the supporting member after the plasma treatment is greater than the hydrophilic properties of the supporting member before the plasma treatment.

17. The inkjet head according to claim 14, wherein the adhesiveness properties of the supporting member after the plasma treatment is greater than the adhesiveness properties of the supporting member before the plasma treatment.

18. The inkjet head according to claim 1, wherein the third area is more hydrophilic than the first and second areas.

* * * * *